US005975333A

United States Patent [19]

Lee

[11] Patent Number: 5,975,333

[45] Date of Patent: Nov. 2, 1999

[54] DRIP CATCH BEVERAGE MUG

[76] Inventor: Thomas Lee, 1520 Westmoreland, Waukegan, Ill. 60085

[21] Appl. No.: 09/037,595

[22] Filed: Mar. 10, 1998

[51] Int. Cl.[6] ..... B65D 90/00

[52] U.S. Cl. ..... 220/571; 220/393; 220/DIG. 6; 215/392

[58] Field of Search ..... 220/DIG. 6, 703, 220/571; 215/392, 393

[56] References Cited

U.S. PATENT DOCUMENTS

| | | | |
|---|---|---|---|
| 2,727,645 | 12/1955 | Dore | 215/393 |
| 2,948,452 | 8/1960 | Grogan et al. | 215/392 |
| 3,103,295 | 9/1963 | Ghee | 215/393 |
| 3,279,638 | 10/1966 | Merry | 215/393 |
| 4,699,282 | 10/1987 | Farrar | 220/DIG. 6 |
| 4,733,790 | 3/1988 | Stein | 220/371 |
| 4,930,648 | 6/1990 | Hundt | 220/DIG. 6 |
| 4,995,524 | 2/1991 | Wells | 220/393 |

FOREIGN PATENT DOCUMENTS

| | | | |
|---|---|---|---|
| 277593 | 12/1951 | Switzerland | 215/392 |

*Primary Examiner*—Joseph M. Moy
*Attorney, Agent, or Firm*—Michael I. Kroll

[57] ABSTRACT

A drip catch beverage mug (10) comprising a cylindrical bowl (12) having an open top end (14) and a closed bottom end (16) to receive a beverage liquid (18) therein. A structure (20) about the outer circumference (22) of the cylindrical bowl (12), is for capturing any of the beverage liquid (18) spilled out from the cylindrical bowl (12) when a person drinks.

4 Claims, 5 Drawing Sheets

DRIP CATCH BEVERAGE MUG

BACKGROUND OF THE INVENTION

1. Field of the Invention

The instant invention relates generally to drinking cups and more specifically it relates to a drip catch beverage mug. The drip catch beverage mug will help prevent the spillage of a beverage liquid therefrom when a person is drinking and walking, so as to stop damage and stains on table tops, counters, desks, furniture, documents, paperwork, floors and rugs. A catch moat is formed about the outer circumference of a cylindrical bowl, which will divert the spilled beverage liquid to an internal storage chamber for disposal at a later time.

2. Description of the Prior Art

Numerous drinking cups have been provided in prior art that are small bowl shaped open containers, usually with flat bottoms and handles that are used for placing liquids into the mouth to be swallowed. While these units may be suitable for the particular purpose to which they address, they would not be as suitable for the purposes of the present invention as heretofore described.

SUMMARY OF THE INVENTION

A primary object of the present invention is to provide a drip catch beverage mug that will overcome the shortcomings of the prior art devices.

Another object is to provide a drip catch beverage mug that will help prevent the spillage of a beverage liquid therefrom when a person is drinking and walking, so as to stop damage and stains on table tops, counters, desks, furniture, documents, paperwork, floors and rugs.

An additional object is to provide a drip catch beverage mug that contains a catch moat formed about the outer circumference of a cylindrical bowl, which will divert the spilled beverage liquid to an internal storage chamber for disposal at a later time.

A further object is to provide a drip catch beverage mug that is simple and easy to use.

A still further object is to provide a drip catch beverage mug that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
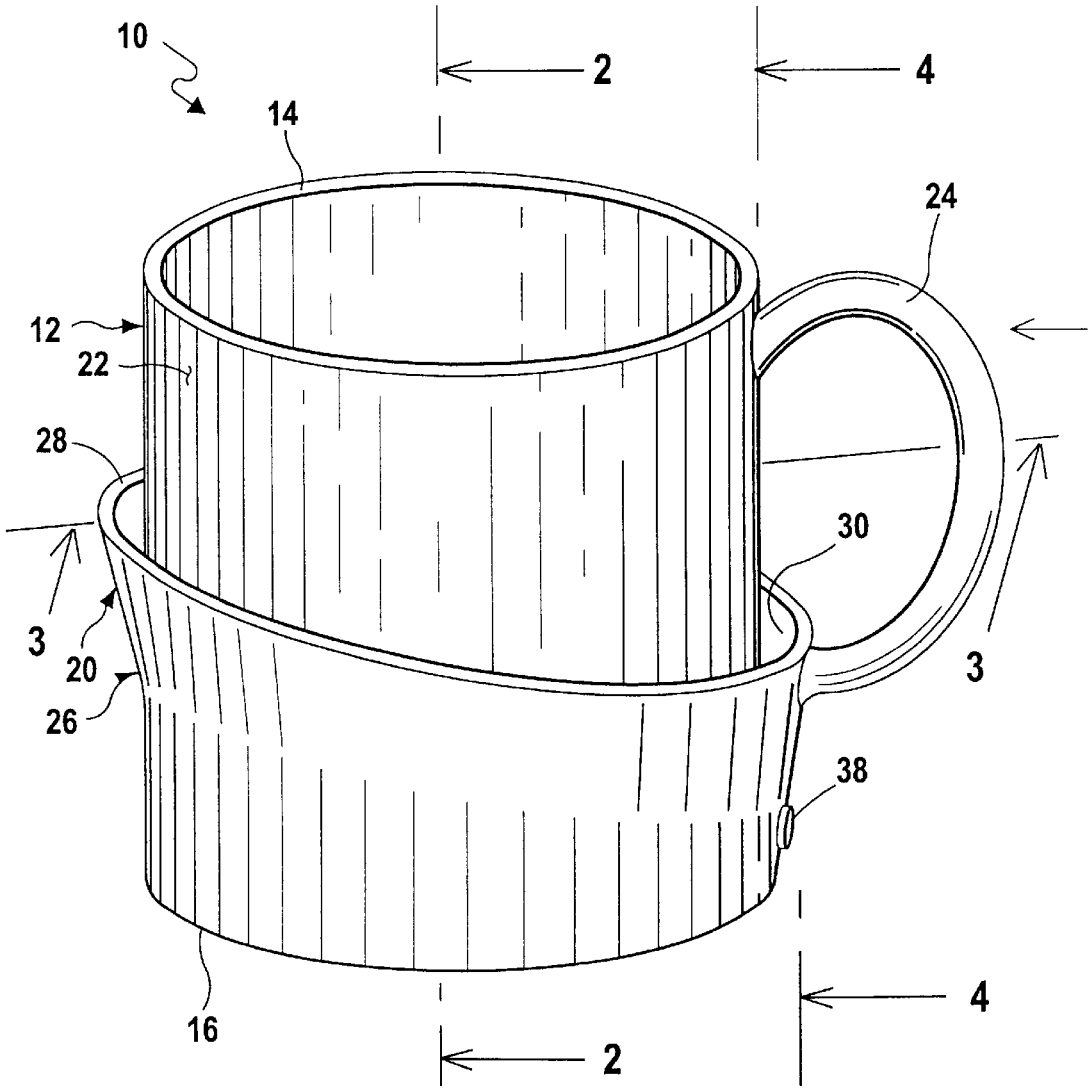
FIG. 1 is a side perspective view of the present invention.
Figure 2:
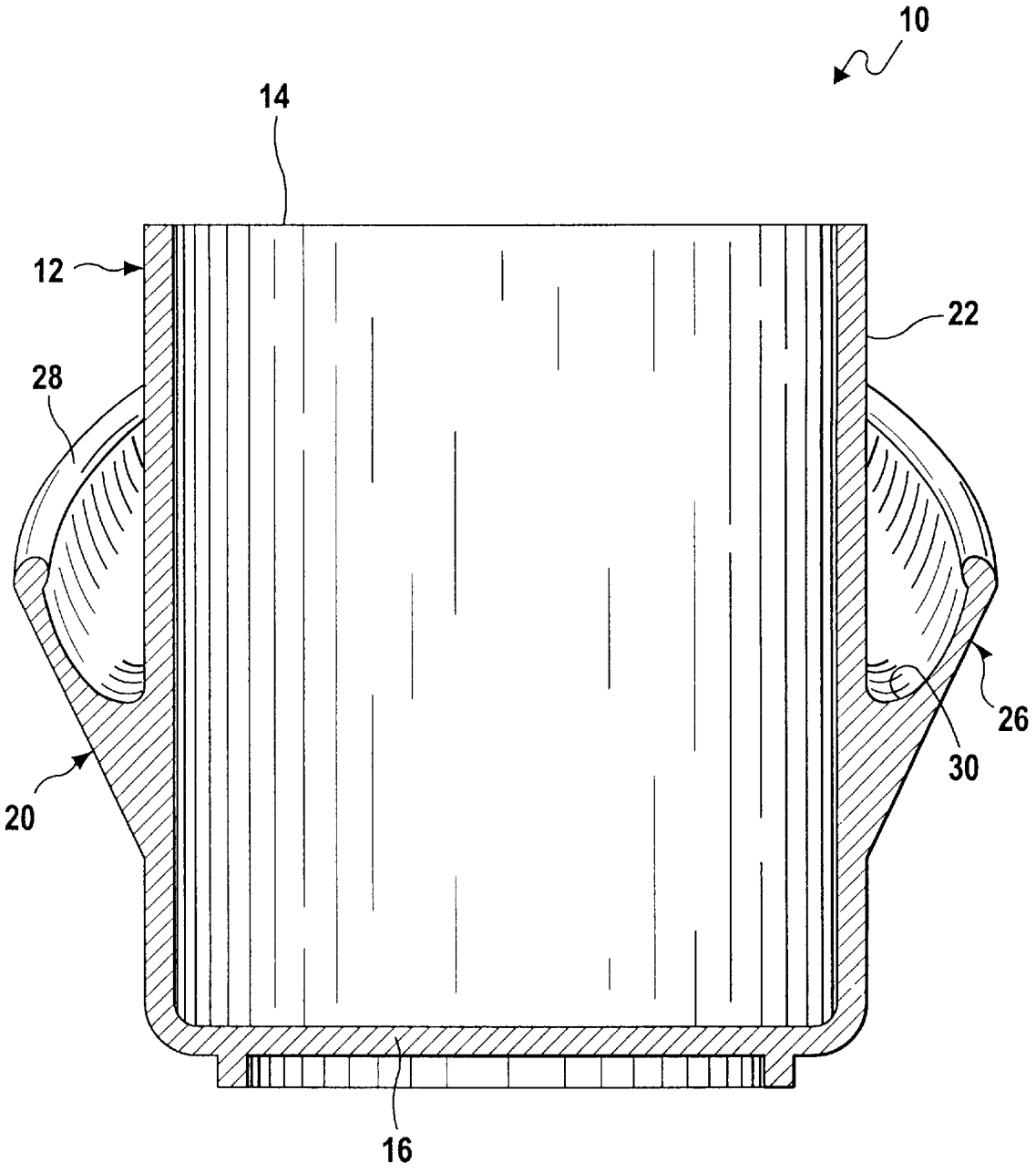
FIG. 2 is a cross sectional view taken along line 2—2 in FIG. 1.
Figure 3:
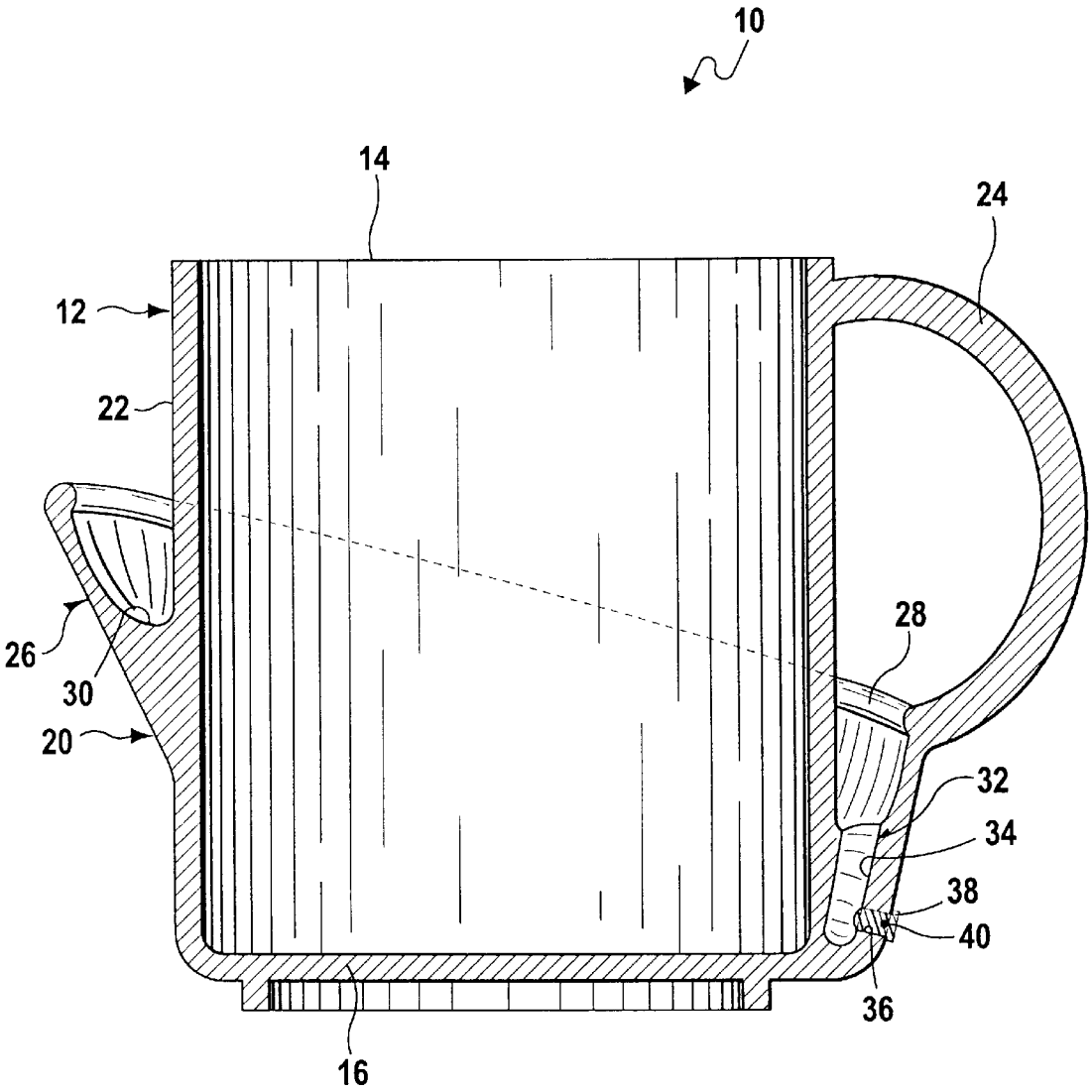
FIG. 3 is a cross sectional view taken along line 3—3 in FIG. 1.
Figure 4:
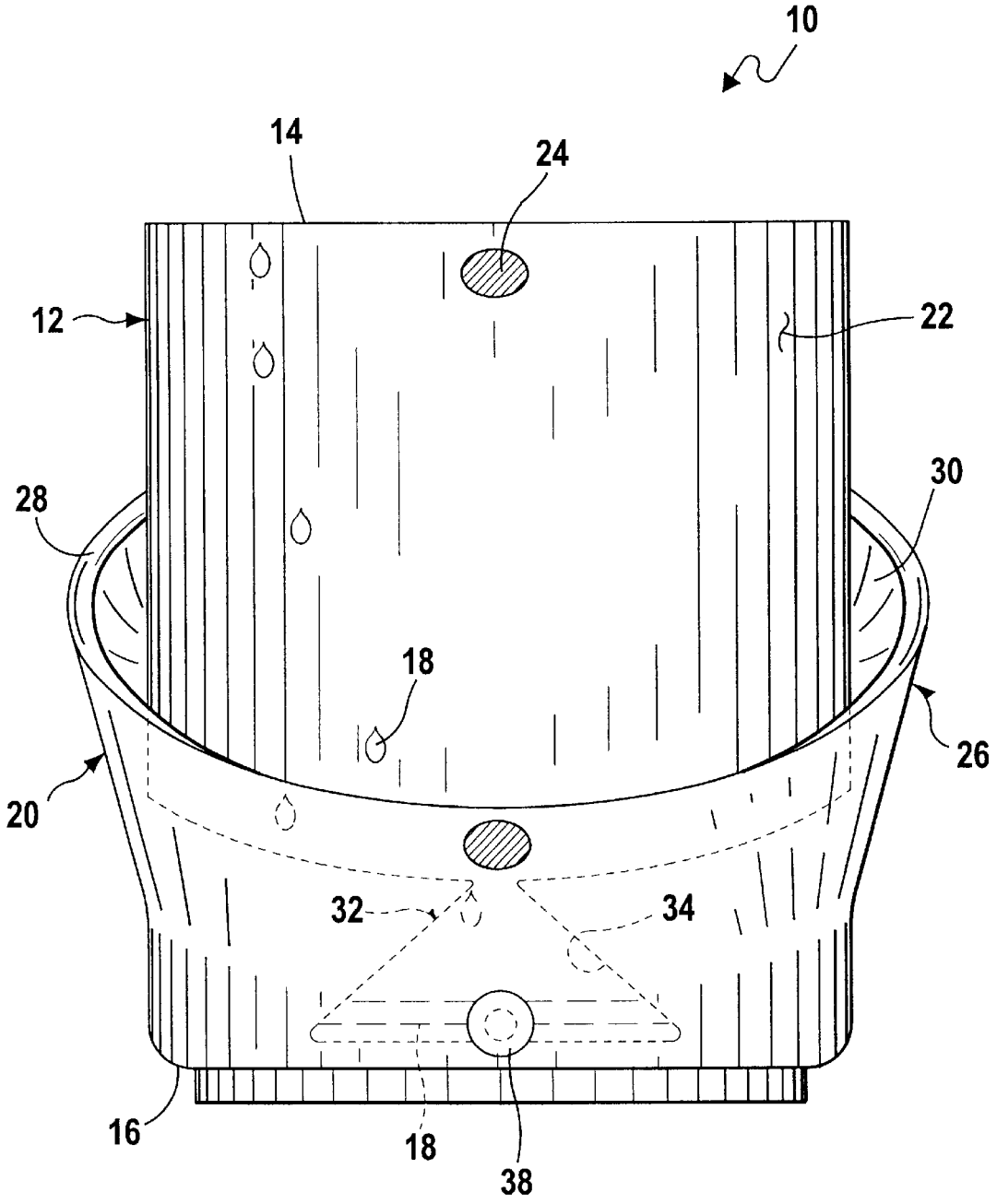
FIG. 4 is a cross sectional view taken along line 4—4 in FIG. 1, showing the beverage liquid droplets going into the catch moat and directed to the triangular shaped storage chamber.
Figure 5:
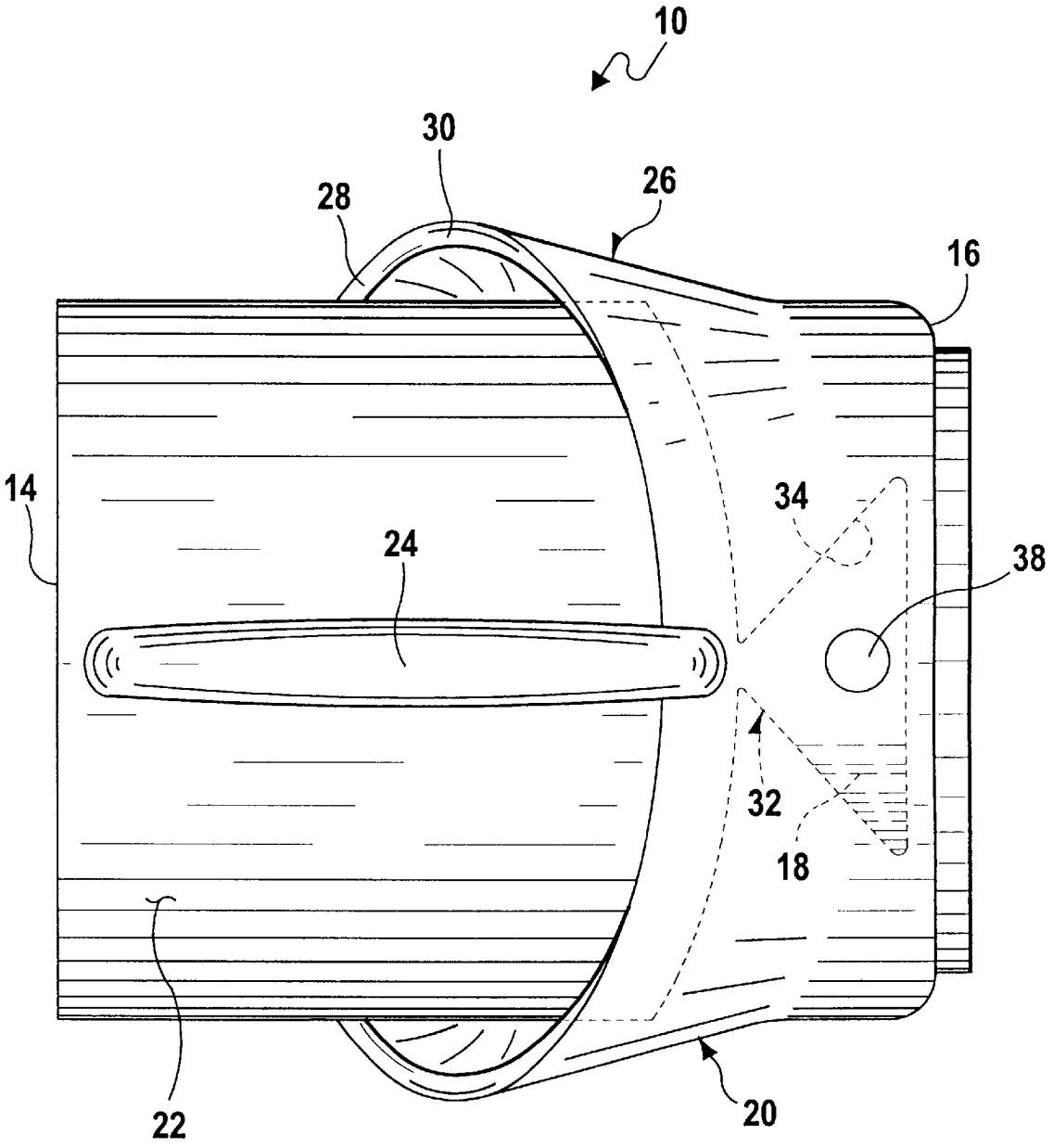
FIG. 5 is a rear elevational view taken in the direction of arrow 5 in FIG. 1, showing the present invention tipped over on its side, with the beverage liquid contained within the triangular shaped storage chamber.

Turning now descriptively to the drawings, in which similar reference characters denote similar elements throughout the several views, FIGS. 1 through 5 illustrate the present invention being a drip catch beverage mug 10. With regard to the reference numerals used, the following numbering is used throughout the various drawing figures.

10 drip catch beverage mug

12 cylindrical bowl of 10

14 open top end of 12

16 closed bottom end of 12

18 beverage liquid

20 beverage liquid capturing structure of 10

22 outer circumference of 12

24 handle of 10

26 catch moat for 20

28 annular lip on 26

30 rearwardly tapered channel in 26

32 holding facility in 26

34 triangular storage chamber for 32

36 drain hole in 34

38 drain plug in 36

40 strong durable material (pliable plastic) for 38

The drip catch beverage mug 10 comprises a cylindrical bowl 12 having an open top end 14 and a closed bottom end 16, to receive a beverage liquid 18 therein. A structure 20 about the outer circumference 22 of the cylindrical bowl 12, is for capturing any of the beverage liquid 18 spilled out from the cylindrical bowl 12 when a person drinks. A handle 24 is at the rear of the cylindrical bowl 12. The handle 24 is grasped by a hand of a person, so that the person can lift up and tilt the cylindrical bowl 12, to pour the beverage liquid 18 into the mouth and swallow.

The beverage liquid capturing structure 20 is a catch moat 26, circularly formed about the outer circumference 22 of the cylindrical bowl 12 and set below the open top end 14 thereof. The catch moat 26 includes an annular lip 28 tapered rearwardly. The catch moat 26 further contains a rearwardly tapered channel 30, to direct the capture beverage liquid 18 to the rear of the cylindrical bowl 12.

The catch moat 26 also includes a facility 32 at the rear, for holding the beverage liquid 18, for disposal at a later time. The holding facility 32 is a storage chamber 34. The storage chamber 34 is triangular shaped, so that when the cylindrical bowl 12 with the catch moat 26 is tipped over on its side, the captured beverage liquid 18 contained within the storage chamber 34 will not spill out.

The storage chamber 34 has a drain hole 36 located at the bottom, to allow the captured beverage liquid 18 to exit therefrom. A drain plug 38 fits into the drain hole 36, to keep the captured beverage liquid 18 within the storage chamber

34. When the drain plug 38 is removed from the drain hole 36, the captured beverage liquid 18 will now exit therefrom.

The drain plug 38 is fabricated out of a strong durable material 40 that can be placed into a microwave oven. The strong durable material 40 is a pliable plastic.

OPERATION OF THE INVENTION

To use the drip catch beverage mug 10, the following steps should be taken:

1. Place the cylindrical bowl 12 upon a horizontal support surface.
2. Fill the cylindrical bowl 12 with the beverage liquid 18 through the open top end 14.
3. Grasp the handle 24 by the hand.
4. lift up the drip catch beverage mug 10 by the handle 24.
5. Allow any of the spilled beverage liquid 18 to go into the rearwardly tapered channel 30 in the catch moat 26, and they enter into the storage chamber 34.
6. Tip over the cylindrical bowl 12 with the catch moat 26 to drink the beverage liquid 18 from the cylindrical bowl 12, so that the captured beverage liquid 18 contained within the storage chamber 34 will not spill out, since it is triangular shaped.
7. Put the cylindrical bowl 12 back upon the horizontal support surface.
8. Remove the drain plug 38 from the drain hole 36, so that the captured beverage liquid 18 within the storage chamber 34 can now exit therefrom.
9. Replace the drain plug 38 back into the drain hole 36.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A drip catch beverage mug comprising:

a) a cylindrical bowl having an open top end and a closed bottom end to receive a beverage liquid therein;

b) means about the outer circumference of said cylindrical bowl, for capturing any of the beverage liquid spilled out from said cylindrical bowl when a person drinks;

c) said beverage liquid capturing means being a catch moat circularly formed about the outer circumference of said cylindrical formed by a wall surrounding and spaced from the outer circumference of said bowl and having an annular lip along the top of said wall tapered down from a front side of said bowl to an opposite, rear side thereof, said lip being below the top end of said bowl;

d) a handle at the rear of said bowl for grasping by a user;

e) said moat including a rearwardly tapered channel to direct captured beverage liquid to the rear of said cylindrical bowl, the lowest point of said moat, aligned with said handle; and f) means comprising a partially enclosed storage chamber below the bottom of said moat at the rear of said bowl in communication with said moat for trapping captured liquid for disposal at a later time.

2. A drip catch beverage mug as recited in claim 1, wherein said storage chamber is triangular shaped, so that when said cylindrical bowl with said catch moat is tipped over on its side, the captured beverage liquid contained within said storage chamber will not spill out.

3. A drip catch beverage mug as recited in claim 2, wherein said storage chamber has a drain hole located at the bottom to allow the captured beverage liquid to exit therefrom.

4. A drip catch beverage mug as recited in claim 3, further including a drain plug which fits into said drain hole to keep the captured beverage liquid within said storage chamber, so that when said drain plug is removed from said drain hole, the captured beverage liquid will now exit therefrom.

* * * * *